US005992956A

United States Patent [19]

Slivon

[11] Patent Number: 5,992,956

[45] Date of Patent: Nov. 30, 1999

[54] INCLINED SLIDE ASSEMBLIES FOR VERTICAL DRAWERS

[75] Inventor: George R. Slivon, Kenosha, Wis.

[73] Assignee: Snap-On Tools Company, Kenosha, Wis.

[21] Appl. No.: 09/032,539

[22] Filed: Feb. 27, 1998

[51] Int. Cl.[6] ..... A47B 88/00

[52] U.S. Cl. ..... 312/334.25; 312/334.28; 312/334.38

[58] Field of Search ..... 312/334.24, 311, 312/334.25, 334.6, 334.28, 334.38

[56] References Cited

U.S. PATENT DOCUMENTS

| | | | |
|---|---|---|---|
| 339,614 | 4/1886 | Beale . | |
| 676,748 | 6/1901 | Hargrave | 312/334.38 |
| 734,497 | 7/1903 | Anderson . | |
| 768,927 | 8/1904 | Billings . | |
| 893,187 | 7/1908 | Montague . | |
| 958,991 | 5/1910 | Burton . | |
| 1,091,393 | 3/1914 | Schulde et al. | 312/311 X |
| 1,111,026 | 9/1914 | Kroos . | |
| 1,203,014 | 10/1916 | Kroos | 312/334.38 |
| 2,604,997 | 7/1952 | Pearson . | |
| 2,627,447 | 2/1953 | Cook . | |
| 2,699,370 | 1/1955 | Weiskopf . | |
| 3,190,712 | 6/1965 | Fielden | 312/311 |
| 3,333,914 | 8/1967 | Anderson . | |
| 3,509,665 | 5/1970 | Barlett et al. | 312/334.28 X |
| 3,853,364 | 12/1974 | Lundberg . | |
| 3,874,756 | 4/1975 | Greene | 312/334.24 X |
| 3,929,386 | 12/1975 | Read . | |
| 4,095,854 | 6/1978 | Teramachi | 312/334.38 X |
| 4,236,773 | 12/1980 | Mertes . | |
| 4,397,509 | 8/1983 | Miller et al. | 312/311 X |
| 4,549,774 | 10/1985 | Bessinger et al. . | |
| 4,606,588 | 8/1986 | Koch | 312/334.38 X |
| 4,752,143 | 6/1988 | Lautenschlager, Jr. . | |
| 4,779,999 | 10/1988 | Lautenschlager . | |
| 4,958,730 | 9/1990 | Bunten | 312/311 X |
| 5,131,732 | 7/1992 | Lane et al. | 312/311 X |
| 5,403,084 | 4/1995 | Kane et al. . | |
| 5,421,653 | 6/1995 | Triplette . | |
| 5,468,063 | 11/1995 | Simonek | 312/334.24 X |
| 5,590,940 | 1/1997 | Richard . | |

FOREIGN PATENT DOCUMENTS

| | | | |
|---|---|---|---|
| 922464 | 1/1955 | Germany | 312/334.28 |
| 405309023 | 11/1993 | Japan | 312/334.25 |

*Primary Examiner*—Jose V. Chen
*Assistant Examiner*—Hanh V. Tran
*Attorney, Agent, or Firm*—Emrich & Dithmar

[57] ABSTRACT

A tool cabinet has a plurality of vertically-oriented drawers, each slidably supported at its upper and lower ends by upper and lower drawer slide assemblies, wherein each slide assembly is coupled between facing support surfaces on the drawer and the cabinet frame, which surfaces are inclined to both the horizontal and vertical in use. The cabinet also includes horizontal drawers and an access door. Each vertical drawer has a pegboard-type panel on which associated tools or articles may be hung.

17 Claims, 4 Drawing Sheets

INCLINED SLIDE ASSEMBLIES FOR VERTICAL DRAWERS

BACKGROUND OF THE INVENTION

The present invention relates to storage cabinets for articles such as tools and, in particular, to vertically-oriented drawers or like storage units for such cabinets.

Typical tool chests or cabinets are provided with horizontally arranged shelves, drawers, trays and the like for containing or supporting tools or other items. Since horizontal drawers can sometimes make it difficult for the user, such as an automotive mechanic or the like, to readily see or gain access to the contents of a drawer, tool cabinets or storage devices have also been provided with upstanding support panels or pallets or the like on which tools can be clipped or hung for better display to the user. Such upright arrangements may, for example, include wall cabinets, with a tool-support wall arranged vertically in use, and tool chests with pop-up tool pallets, which can be raised from a horizontal position to an upstanding position for better display and access. However, wall cabinets and tool chests with pop-up pallets have only a single pallet or tool-support wall.

In other applications, it has been known to provide cabinets with vertically-arranged drawers or storage units which can be slidably moved between closed positions within the cabinet and open positions extending from the cabinet, and on which items may be hung or clipped. In prior drawer cabinets, the drawers, whether vertical or horizontal, are typically supported on drawer slide assemblies, which commonly include two or three interfitted slide members or rails slidably movable relative to each other, usually with the aid of a friction-reducing arrangement, such as the use of low-friction materials, ball races and the like. The rails or tracks of these drawer slide assemblies are commonly channel-shaped, having a width substantially greater than the depth, the assemblies typically being mounted with the channel width oriented vertically in use. Thus, when the drawer is pulled out to its open position, the drawer slide assembly has uneven rigidity in horizontal and vertical directions.

SUMMARY OF THE INVENTION

It is a general object of the invention to provide a drawer and slide combination which avoids the disadvantages of prior arrangements while affording additional structural and operating advantages.

An important feature of the invention is the provision of a drawer and slide combination which has improved rigidity in the open position.

In connection with the foregoing feature, another feature of the invention is the provision of a combination of the type set forth, which is particularly adapted for use with vertically-arranged drawers.

Another feature of the invention is the provision of a combination of the type set forth, which includes drawer slide assemblies of the type utilizing elongated, relatively slidable tracks or rails.

Still another feature of the invention is the provision of a tool cabinet incorporating drawer and slide combinations of the type set forth.

Certain ones of these and other features of the invention may be attained by providing in combination, a drawer and a slide apparatus therefor, the combination comprising: a frame having upper and lower non-parallel support surfaces, an upstanding drawer having upper and lower ends respectively disposed adjacent to the upper and lower support surfaces, an upper slide mechanism connecting the upper end of the drawer to the upper support surface for relative sliding movement parallel to the upper support surface, and a lower slide mechanism connecting the lower end of the drawer to the lower support surface for relative sliding movement parallel to the lower support surface.

Other features of the invention may be attained by providing a combination of the type set forth, wherein each slide mechanism includes slide members respectively fixed to the drawer and the frame support surface.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
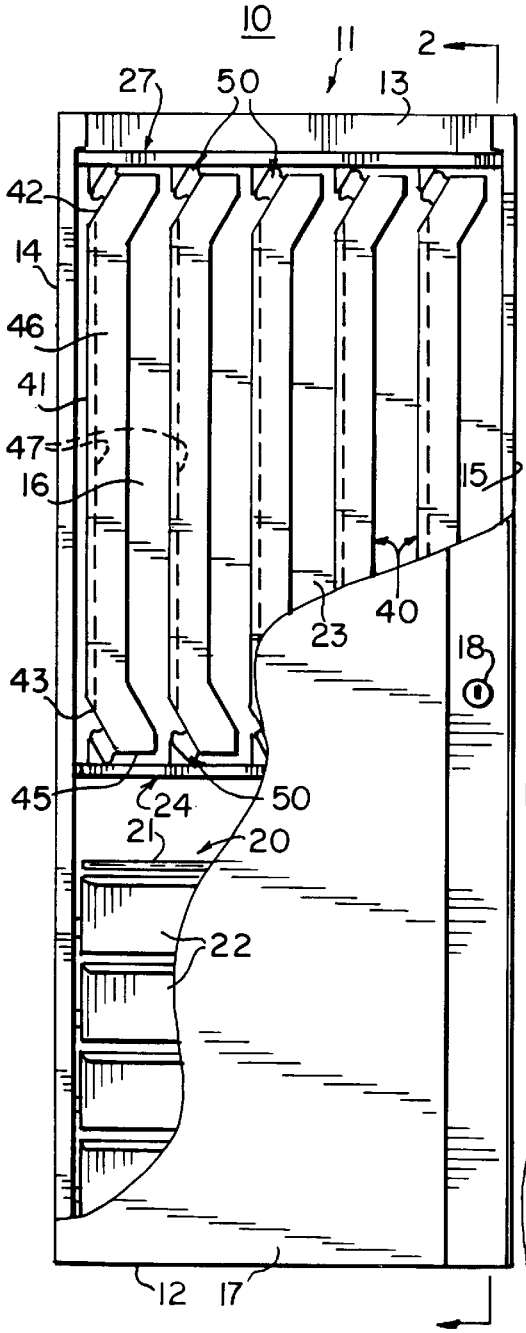
FIG. 1 is a front elevational view of a tool cabinet constructed in accordance with and embodying features of the present invention, with a portion of the door broken away to show internal construction.
Figure 2:
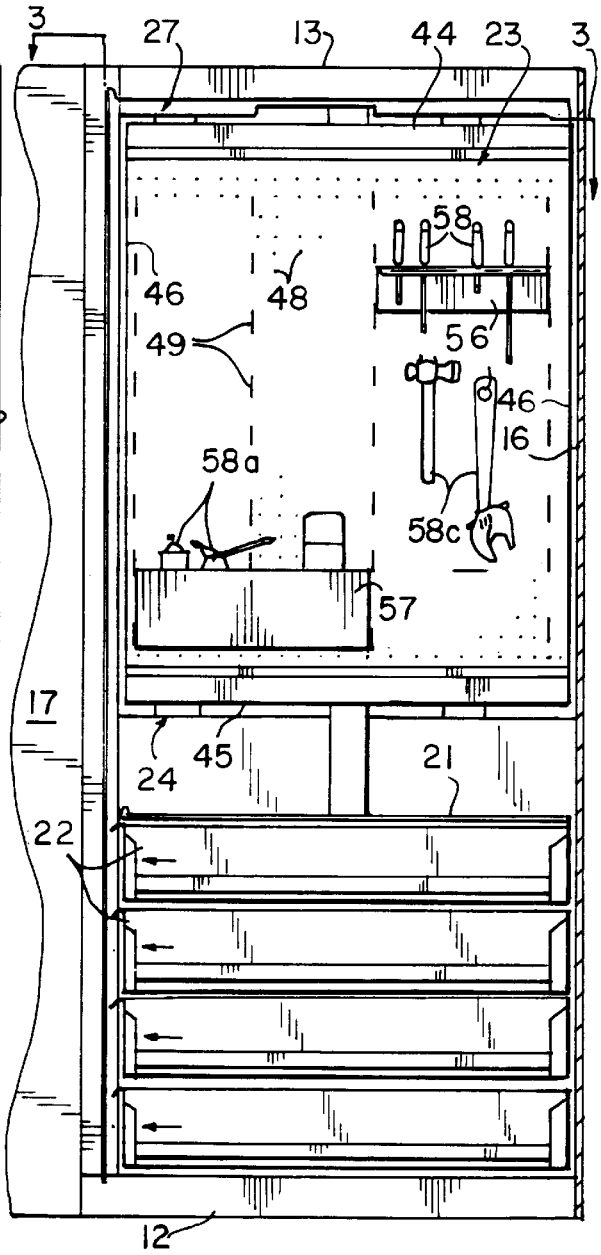
FIG. 2 is a view in vertical section taken along the line 2—2 in FIG. 1, with the door shown fragmentarily in open position.
Figure 3:
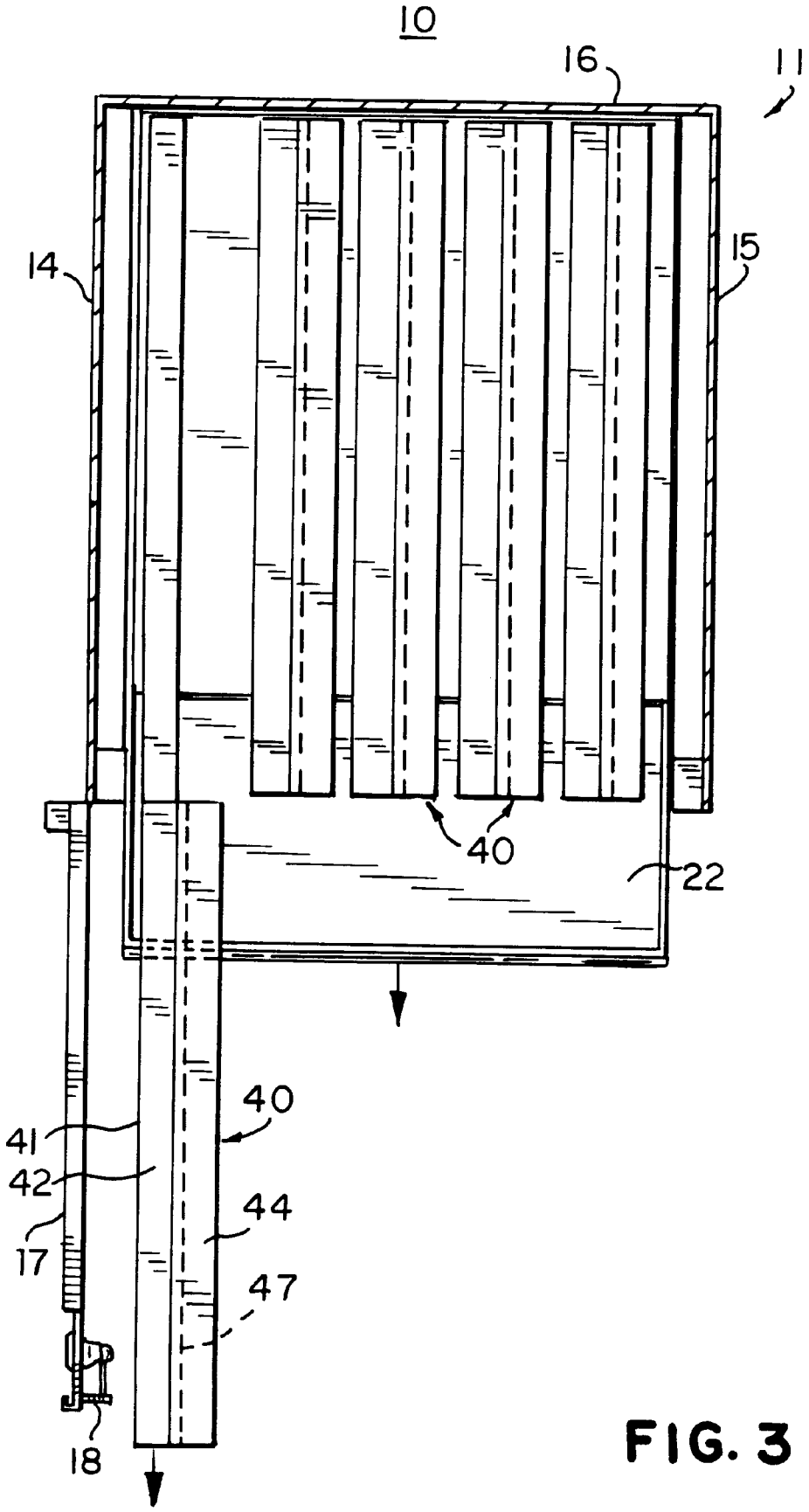
FIG. 3 is a view in horizontal section taken along the line 3—3 in FIG. 2, and illustrating one vertical drawer and one horizontal drawer in open position.

Referring to FIGS. 1–3, there is illustrated a tool cabinet, generally designated by the numeral 10, constructed in accordance with and embodying the features of the present invention. The tool cabinet 10 has a generally box-like, upstanding housing 11 including a bottom wall 12, a top wall 13, opposed side walls 14 and 15, and a rear wall 16, being closed by a front door 17 provide with a lock 18. The tool cabinet 10 includes a lower storage compartment 20, defined generally between a horizontal shelf 21 and the bottom wall 12. A plurality of vertically-spaced horizontal drawers 22 are disposed in the lower storage compartment 20 and are mounted for sliding movement on standard ball slide assemblies (not shown) for movement between a closed position, illustrated in FIGS. 1 and 2, disposed entirely within the lower storage compartment 20, and an open position extending from the storage compartment 20, as indicated in FIG. 3. The drawers 20 are opened by moving in the direction of the arrows in FIGS. 2 and 3.

Figure 4:
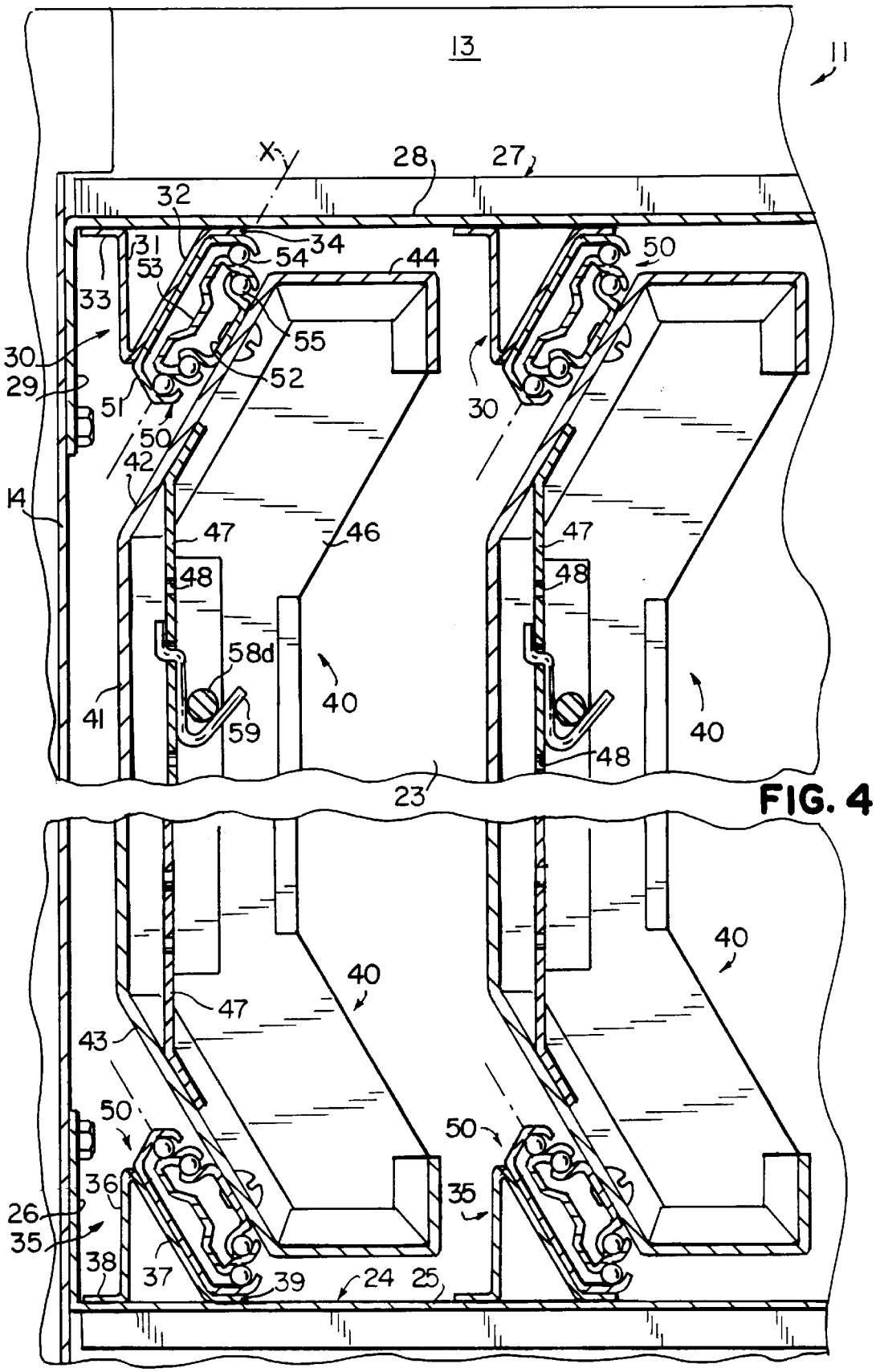
FIG. 4 is an enlarged, fragmentary view in vertical section of the upper portion of FIG. 1, illustrating details of the vertical drawers and drawer slide assemblies therefor.
Figure 5:
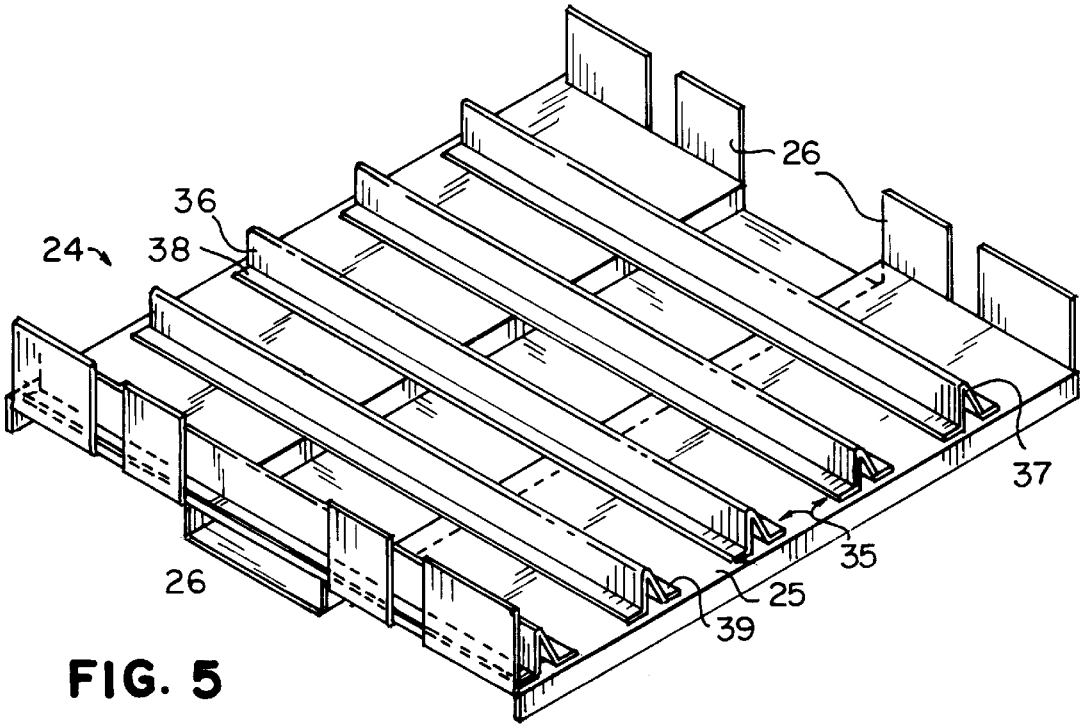
FIG. 5 is a perspective view of one of the drawer slide support and frame assemblies of the cabinet of FIG. 1.

The tool cabinet 10 also has an upper storage compartment 23 and a framework including a lower frame member 24 mounted above the shelf 21 and an upper frame member 27 mounted beneath the top wall 13, which frame members respectively define the lower and upper ends of the upper storage compartment 23. Referring also to FIGS. 4 and 5, the lower frame member 24 has a generally horizontally disposed base wall 25 with upstanding attachment flanges 26 for attachment, respectively, to the housing side walls 14 and 15, while the upper frame member 27 has a base wall 28 and attachment flanges 29. Mounted on the upper frame member 27 at laterally spaced-apart locations thereon are a plurality of upper drawer slide supports 30, while a like plurality of lower drawer slide supports 35 are mounted on the lower frame member 24. The assembly of the upper frame member 27 an upper drawer slide supports 30 is arranged as a mirror image of the assembly of the lower frame member 24 and lower drawer slide supports 35, the lower assembly being illustrated in FIG. 5.

Each of the upper drawer slide supports 30 is an elongated member extending the entire front-to-back depth of the upper storage compartment 23 and includes a vertical wall 31 integral with an inclined wall 32, the walls 31 and 32 being respectively provided at their distal ends with attachment flanges 33 and 34 which are, respectively, fixedly secured to the upper frame member 27, as by welding. Similarly, each of the lower drawer slide supports 35 has a vertical wall 36, an inclined wall 37 and attachment flanges 38 and 39 which are, respectively, fixed to the base wall 25 of the lower frame member 24. The upper drawer slide supports 30 are, respectively, vertically aligned with the lower drawer slide supports 35 to form vertically spaced pairs, so that in each pair the vertical walls 31 and 36 are substantially coplanar, and the inclined walls 32 and 37 respectively lie in intersecting planes. In the preferred embodiment, the inclined walls 32 and 37 respectively intersect the vertical walls 31 and 36 at an angle of about 30°. However, other angles, such as 45°, could also be used.

Also disposed in the upper storage compartment 23 are a plurality of vertically-arranged drawers or panel assemblies 40, with each drawer 40 being disposed between the upper and lower drawer slide supports 30 and 35 of a vertically-aligned pair. The drawers 40 are of identical construction, each having a vertical wall 41 arranged parallel to the cabinet side walls 14 and 15 and integral at its upper and lower ends with upper and lower inclined walls 42 and 43, which respectively slope upwardly and downwardly in the same lateral direction, so as to be respectively substantially parallel to the inclined walls 32 an 37 of the associated drawer slide supports 30, 35. The inclined walls 42 and 43 are respectively integral at their distal ends with top and bottom walls 44 an 45, all of the walls 41–45 being provided at their front and rear ends with attachment flanges to facilitate attachment to end walls 46. Mounted within the drawer 40 between the inclined walls 42 and 43 and parallel to the vertical wall 41 is a tool support panel 47, which is perforated with a plurality of substantially uniformly spaced holes 48 and vertically elongated slots 49.

The upper and lower inclined walls 42 and 43 of each drawer 40 are respectively coupled to the inclined walls 32 and 37 of the associated drawer slide supports 30 and 35 by drawer slide assemblies 50, which are of substantially identical construction. Each drawer slide assembly 50 is preferably a ball slide assembly of known construction, having three slide members, including a frame slide member 51 fixed to the inclined wall 32 or 37 of the associated drawer slide support 30 or 35, a drawer slide member 52 fixed to the associated inclined wall 42 or 43 of the drawer 40, and an intermediate slide member 53. A ball race 54 is interposed between the frame slide member 51 and the intermediate slide member 53, while a ball race 55 is interposed between the intermediate slide member 53 and the drawer slide member 52, as illustrated in FIG. 4, all in a known manner. Thus, each drawer slide assembly 50 has an axis plane X which is substantially parallel to the inclined walls 32, 42 or 37, 43 of the associated drawer slide support 30, 35 and drawer 50.

In use, the drawer 40 can be slid from its closed position to its open position in the direction of the arrows in FIGS. 2 and 3 to provide access thereto by the user. The inclined arrangement of the drawer slide assemblies 50 provides improved rigidity for each drawer 40 in its open position, resisting deflecting forces in both vertical and horizontal directions. In the illustrated embodiment the arrangement will have a slightly greater resistance to horizontal force components than to vertical force components. If, on the other hand, the inclined walls 32, 37 and 42, 43 were inclined at 45° angles, they would have substantially equal resistance to both horizontal and vertical force components.

It will be appreciated that tools can be hung or clipped onto the drawer tool support panels 47 by any known means. Thus, for example, separate tool holders 56 or 57 could be hung on the tool support panel 47 by the use of suitable hooks, clips or the like, for respectively supporting pluralities of tools, such as screwdrivers 58 or cans or other containers 58*a*. Alternately, tools, such as a hammer 58*b* (FIG. 2) or other type of tool 58*c* or 58*d* (FIGS. 2 and 4) may be individually mounted by the use of hooks 59, in a known manner.

Figure 6:
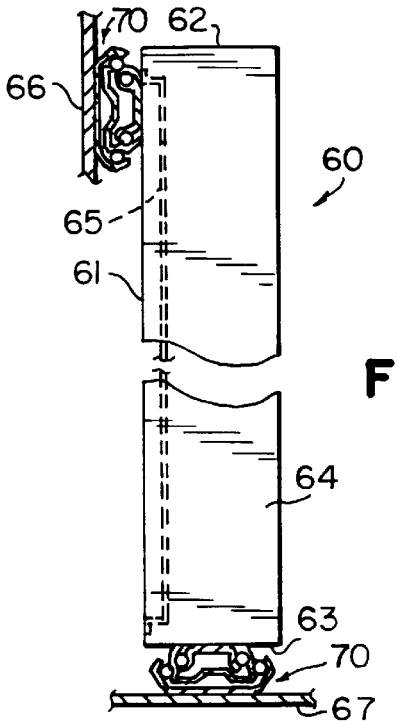
FIG. 6 is a front elevational view of an alternative embodiment of the vertical drawer and slide assembly of the present invention.

While, in the preferred embodiment described above, the upper and lower drawer slide assemblies 50 are arranged in mirror image arrangement, other configurations could be utilized. Referring to FIG. 6, there is illustrated an alternative arrangement for mounting a vertical drawer 60 having a vertical rear wall 61, horizontal top an bottom walls 62 and 63 and vertical end walls 64, supporting therein a vertically-arranged tool support panel 65. In this case, the drawer 60 is supported at its upper and lower ends by two drawer slide assemblies 70, which may be identical to the drawer slide assemblies 50, described above. However, in this case, the upper drawer slide assembly 70 is mounted between the vertical wall 61 of the drawer 60 and an adjacent vertical support member 66, which may depend from the upper frame member 27, while the lower drawer slide assembly 70 is interposed between the bottom wall 63 of the drawer 60 and a horizontal support member 67, which may be the lower frame member 24, or a member mounted thereon. In this arrangement, the drawer slide assemblies 70 are respectively arranged in vertical and horizontal planes so that, in combination, they will still resist deflecting forces in both horizontal and vertical directions.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In combination, a drawer and a slide apparatus therefor, said combination comprising:

a frame having spaced-apart upper and lower non-parallel support surfaces, each of said upper and lower support surfaces being inclined in use with respect to both the vertical and the horizontal, an upstanding drawer having angled upper and lower surfaces respectively disposed adjacent and parallel to said upper and lower support surfaces, an upper slide mechanism connecting said upper surface of said drawer to said upper support surface for relative sliding movement parallel to said upper support surface, and a lower slide mechanism discrete from said upper slide mechanism connecting said lower surface of said drawer to said lower support surface for relative sliding movement parallel to said lower support surface.

2. The combination of claim 1, wherein said upper and lower support surfaces respectively lie in planes which are substantially perpendicular to each other.

3. The combination of claim 2, wherein one of said planes is disposed substantially vertically in use.

4. The combination of claim 1, wherein each of the upper and lower support surfaces is inclined in use at an angle of approximately 30 degrees to the vertical.

5. The combination of claim 1, wherein said upper and lower surfaces being respectively disposed at upper and lower ends of said drawer.

6. The combination of claim 1, wherein each of the upper and lower slide mechanisms includes a multi-part drawer slide assembly.

7. The combination of claim 1, wherein said drawer includes an upstanding perforated support panel from which associated articles may be hung.

8. In combination, a drawer and a slide apparatus therefor, said combination comprising:

a frame having first and second spaced-apart non-parallel frame support surfaces, each of said frame support surfaces being inclined in use with respect to both the vertical and the horizontal, a drawer having angled first and second drawer support surfaces respectively parallel to said first and second frame support surfaces, and first and second slide assemblies discrete from each other and respectively slidably connecting said first and second drawer support surfaces to said first and second frame support surfaces, each of said slide assemblies including an elongated drawer slide member fixed to the associated drawer support surface and an elongated frame slide member fixed to the associated frame support surface.

9. The combination of claim 8, wherein said drawer is disposed substantially vertically in use, said first and second drawer support surfaces respectively being disposed at upper and lower ends of the drawer.

10. The combination of claim 8, wherein each of said slide assemblies includes an intermediate slide member disposed between said drawer slide member and said frame slide member.

11. The combination of claim 10, wherein each of said slide assemblies includes ball races interposed between adjacent ones of the slide members.

12. The combination of claim 8, wherein said frame includes first and second support brackets elongated in the direction of sliding movement of the drawer and respectively having said first and second frame support surfaces formed thereon.

13. A tool cabinet comprising:

a housing defining a storage compartment and having spaced-apart upper and lower frame members each having plural support surfaces thereon, the support surfaces on each frame member being substantially parallel to one another but non-parallel to the support surfaces on the other frame member, each of said support surfaces being inclined in use with respect to both the vertical and the horizontal, a plurality of vertical drawers each having angled surfaces diposed parallel to the support surfaces, and a plurality of support assemblies respectively supporting said drawers for sliding movement between a closed position disposed entirely within the storage compartment and an open position extending from the storage compartment, each support assembly including an upper slide assembly carried by one of the support surfaces on the upper frame member and a discrete lower slide assembly carried by a corresponding support surface on the lower frame member.

14. The tool cabinet of claim 13, and further comprising a door carried by said housing and movable between open and closed positions relative to the storage compartment.

15. The tool cabinet of claim 13, wherein each of said upper and lower frame members includes a plurality of support brackets elongated in the direction of sliding movement of the drawers and respectively having said support surfaces formed thereon.

16. The tool cabinet of claim 15, wherein said support surfaces on said upper frame member respectively lie in planes which are substantially perpendicular to planes in which the support surfaces on the lower frame member lie.

17. The tool cabinet of claim 13, wherein each of said slide assemblies includes elongated slide members respectively mounted on the associated drawer and the associated support surface.

* * * * *